US008529753B2

(12) United States Patent
Niu et al.

(10) Patent No.: US 8,529,753 B2
(45) Date of Patent: Sep. 10, 2013

(54) COMBINED PROCESS FOR HYDROTREATING AND CATALYTIC CRACKING OF RESIDUE

(75) Inventors: Chuanfeng Niu, Beijing (CN); Lishun Dai, Beijing (CN); Yongcan Gao, Beijing (CN); Dadong Li, Beijing (CN); Yahua Shi, Beijing (CN); Hong Nie, Beijing (CN); Qinghe Yang, Beijing (CN)

(73) Assignees: Research Institute of Petroleum Processing, Sinopec, Beijing (CN); China Petroleum & Chemical Corporation, Beijing (CN)

( * ) Notice: Subject to any disclaimer, the term of this patent is extended or adjusted under 35 U.S.C. 154(b) by 493 days.

(21) Appl. No.: 12/521,346

(22) PCT Filed: Dec. 27, 2007

(86) PCT No.: PCT/CN2007/003844

§ 371 (c)(1), (2), (4) Date: Jun. 26, 2009

(87) PCT Pub. No.: WO2008/080303

PCT Pub. Date: Jul. 10, 2008

(65) Prior Publication Data

US 2010/0314287 A1 Dec. 16, 2010

(30) Foreign Application Priority Data

Dec. 27, 2006 (CN) ..... 2006 1 0169670

(51) Int. Cl.
*C10G 69/04* (2006.01)

(52) U.S. Cl.
USPC ..... 208/61; 208/57; 208/89; 208/100; 208/212

(58) Field of Classification Search
USPC ..... 208/57, 58, 61, 100, 209, 210, 212, 208/89, 102, 118
See application file for complete search history.

(56) References Cited

U.S. PATENT DOCUMENTS 2,776,930 A * 1/1957 McKeague et al. ..... 208/140
3,775,290 A 11/1973 Peterson et al.

(Continued)

FOREIGN PATENT DOCUMENTS

CN 1025216 C 6/1994
CN 1262306 A 8/2000

(Continued)

OTHER PUBLICATIONS

Wang, Feng, et al., "Processing Technology and Progress of the FCC Slurry", Contemporary Chemical Industry, vol. 32, No. 1, Mar. 2003, pp. 45-49.

(Continued)

*Primary Examiner* — Walter D Griffin
*Assistant Examiner* — Renee E Robinson
(74) *Attorney, Agent, or Firm* — Finnegan, Henderson, Farabow, Dunner & Garrett LLP

(57) ABSTRACT

Disclosed is a combined process for hydrotreating and catalytic cracking of residue, wherein the residue, catalytic cracking heavy cycle oil with acidic solid impurity being removed, optional distillate oil and adistillate of catalytic cracking slurry oil from which the acidic solid impurity is removed are fed into residue hydrotreating unit, the hydrogenated residue obtained and optional vacuum gas oil are fed into catalytic cracking unit to obtain various products; the catalytic cracking heavy cycle oil from which the acidic solid impurity is removed is circulated to the residue hydrotreating unit; the catalytic cracking slurry oil is separated by distilling, the distillate of the catalytic cracking slurry oil after removing off the acidic solid impurity is circulated to the residue hydrotreating unit. This process makes the residue hydrotreating and catalytic cracking being combined together more effectively such that it is not only able to improve product quality of the residue hydrotreating, elongate operation cycle of the residue hydrotreating unit, but also increases the yield of the hydrogenated diesel oil and catalytic cracking light oil, and decreases coking quantity of the catalytic cracking.

28 Claims, 1 Drawing Sheet

(56) References Cited

U.S. PATENT DOCUMENTS

| | | | |
|---|---|---|---|
| 4,565,620 | A | 1/1986 | Montgomery et al. |
| 4,713,221 | A | 12/1987 | Montgomery et al. |
| 4,859,309 | A | 8/1989 | de Vries et al. |
| 5,080,777 | A | 1/1992 | Aegerter, Jr. et al. |
| 5,108,580 | A | 4/1992 | Nongbri et al. |
| 5,152,883 | A | 10/1992 | Melin et al. |
| 6,620,311 | B2 | 9/2003 | Morel et al. |

FOREIGN PATENT DOCUMENTS

| | | | | |
|---|---|---|---|---|
| CN | 1382776 | A | | 12/2002 |
| CN | 1119397 | C | * | 8/2003 |
| CN | 1191334 | C | | 3/2005 |
| CN | 1202219 | C | | 5/2005 |
| GB | 1 557 955 | | | 12/1979 |
| WO | WO 02/102938 | A1 | | 12/2002 |

OTHER PUBLICATIONS

Mu Haitao, et al., "Improving of Feedstock Filters for Residue Hydrotreating Unit", Petroleum Refinery Engineering, vol. 31, vol. 5, 2001, pp. 30-33.

Liu, Cunzhu, et al., "Application of Continuous Filtration Technique for Slurry From RFCCU", Petroleum Refinery Engineering, vol. 31, No. 1, Jan. 2001, pp. 32-34.

* cited by examiner

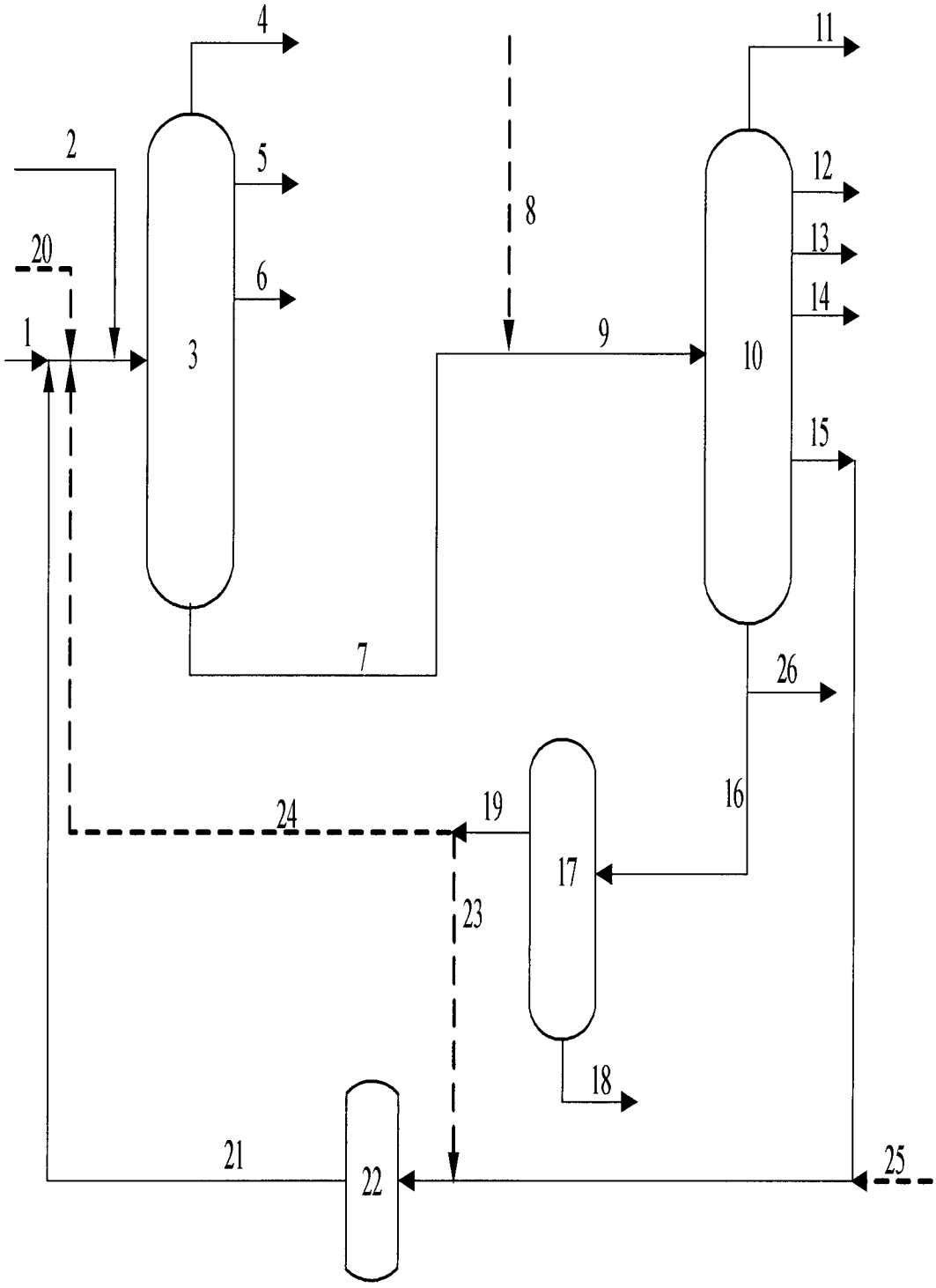
4
11
2
5
12
8
20
6
13
14
1
3
9
10
15
7
26
16
24
19
17
23
18
21
22
25

COMBINED PROCESS FOR HYDROTREATING AND CATALYTIC CRACKING OF RESIDUE

TECHNICAL FIELD

The present invention relates to a process for treating hydrocarbon oil by using one hydrotreating process and another one conversion step, more particularly, a process for combining both hydrotreating process and catalytic cracking process of residue.

TECHNICAL BACKGROUND

Currently, the world is facing a trend that crude oils turn to heavy and poor in quality increasingly, and requirement for heavy fuel oils is decreased down gradually, while requirement for light oils is increasing greatly. Therefore, refinery enterprises are pursuing the maximization of converting residue.

In various processes of lightening residue, it is a good process that residue is hydrotreated in advance, and then the hydrogenated tail oil obtained is further processed by catalytic cracking. After being hydrotreated to remove impurities such as metal, sulfur, nitrogen and the like, the residue has an increased hydrogen content and can be used as a superior-quality feedstock for heavy oil catalytic cracking, making the residue converted completely. Therefore, the process using the hydrogenated tail oil of residue directly as a feedstock for catalytic cracking of heavy oil is now in widespread application increasingly. However, in the combined process, part or all of the catalytic cracking heavy oils remained after separating out catalytic cracking diesel oil, such as, heavy cycle oil, decanted oil and the like, is usually circulated to the catalytic cracking unit to be treated further. However, as heavy cycle oils, decanted oils and the like contain polycyclic aromatics, the yield of light oil is lower, the coking quantity is higher, so that the load of the regenerator is increased, and the treatment capacity and economic benefit of the catalytic cracking unit of heavy oil are decreased. In addition, the heavy cycle oil has a sulfur content about one more time higher than the hydrogenated tail oil, the circulation of the heavy cycle oil also results in increasing sulfur content of products and sulfur emissions.

U.S. Pat. No. 4,713,221 discloses that, on the basis of the combination of conventional residue hydrogenating and catalytic cracking, catalytically cracked (including gas oil catalytic cracking and residue catalytic cracking) heavy cycle oil is circulated to residue hydrogenation unit, and mixed with a topped crude oil to carry out hydrogenation reaction; the hydrogenated residue obtained is introduced into catalytic cracking unit. This small variation may increase the refinery net benefit by 0.29 dollars per barrel of crude oil processed.

CN 1119397C discloses a combined process for hydrotreating-catalytic cracking of residue, comprising: introducing residue and decanted oil together into residue hydrotreating unit to carry out hydrogenation reaction in the presence of hydrogen gas and hydrogenation catalysts; introducing the hydrogenated residue obtained into catalytic cracking unit to carry out cracking reaction in the presence of cracking catalyst, and circulating the heavy cycle oil in the catalytic cracking unit; and separating the slurry oil obtained in a separator to obtain the decanted oil that is returned to the hydrogenation unit.

CN 1165601C discloses a process for combing residue hydrotreating and heavy oil catalytic cracking, comprising: introducing residue and distillate of slurry oil, catalytic cracking heavy cycle oil and optional distillate oil into hydrotreating unit to carry out hydrogenation reaction in the presence of hydrogen gas and hydrogenation catalysts; introducing the hydrogenated residue after separating gasoline and diesel oil, and optional vacuum gas oil into catalytic cracking unit to carry out cracking reaction in the presence of cracking catalyst; introducing the heavy cycle oil obtained into the residue hydrogenation unit, and distilling the slurry oil to obtain a distillate that is returned to the hydrogenation unit.

The aforementioned processes may overcome in a certain extent deficiency existing when the partial or complete catalytic cracking heavy oils, such as heavy cycle oil and decanted oil and the like, that are remained after separating out catalytic cracking diesel oil, are directly circulated to the catalytic cracking unit to be treated further. There are still problems for the hydrogenation unit, such as, poor operational stability and like.

THE CONTENT OF THE INVENTION

An object of the present invention is to provide, on the basis of the prior art, a combined process for hydrotreating and catalytic cracking of residue, which process is able to combine hydrotreating and catalytic cracking of the residue more effectively and can be implemented with better result.

In an embodiment of the present invention, a combined process is provided for hydrotreating and catalytic cracking of residue, comprising: contacting residue, catalytic cracking recycle oil and optional distillate oil with residue hydrotreating catalysts to carry out hydrotreating reaction under hydrotreating reaction conditions in the presence of hydrogen, separating the reaction products obtained to obtain gas, hydrogenated naphtha, hydrogenated diesel oil and hydrogenated residue; contacting the hydrogenated residue and optional conventional catalytic cracking feedstock with catalytic cracking catalyst to carry out cracking reaction under catalytic cracking reaction conditions, separating the reaction products obtained to obtain dry gas, liquefied gas, catalytic cracking gasoline, catalytic cracking diesel oil and catalytic cracking recycle oil; characterized in that, before the step of contacting the residue, catalytic cracking recycle oil and optional distillate oil with the hydrotreating catalyst, the process comprises further a step for removing the acidic solid impurity from the catalytic cracking recycle oil, which step makes the catalytic cracking recycle oil containing less than 30 ppm acidic solid impurity with a particle size of less than 10 μm.

In another embodiment of the present invention, the process according to the present invention comprises the following steps:

(1) Residue, catalytic cracking heavy cycle oil with acidic solid impurity being removed, optional distillate oil and optional distillate of the catalytic cracking slurry oil are fed into residue hydrotreating unit to carry out hydrotreating reaction in the presence of hydrogen gas and hydrogenation catalysts, and the reaction products are separated to obtain gas, hydrogenated naphtha, hydrogenated diesel oil and hydrogenated residue;

(2) The hydrogenated residue obtained from step (1) and optional vacuum gas oil are fed into catalytic cracking unit to carry out cracking reaction in the presence of cracking catalyst, and the reaction products are separated to obtain dry gas, liquefied gas, catalytic cracking gasoline, catalytic cracking diesel oil, catalytic heavy cycle oil and catalytic slurry oil, (3) The catalytic cracking heavy cycle oil obtained from step (2) is processed to remove the acidic solid impurity, and the catalytic cracking heavy cycle oil after removing off the acidic solid impurity contains less than 30 ppm acidic solid impurity with particle size of less than 10 micrometer.

(4) The catalytic cracking heavy cycle oil obtained from step (3), from which the acidic solid impurity is removed, is circulated to the residue hydrotreating unit.

The process according to the present invention is illustrated in details as follows:

(1) Step for Hydrotreating

Residue, catalytic cracking recycle oil and optional distillate oil are fed into residue hydrotreating unit to carry out hydrotreating reaction in the presence of hydrogen gas and hydrogenation catalysts, and the reaction products obtained are separated to obtain gas, hydrogenated naphtha, hydrogenated diesel oil and hydrogenated residue.

Furthermore, residue, catalytic cracking heavy cycle oil with acidic solid impurity being removed, optional distillate oil and optional distillate of the catalytic cracking slurry oil are fed into residue hydrotreating unit to carry out hydrotreating reaction in the presence of hydrogen gas and hydrogenation catalyst, and the reaction products are separated to obtain gas, hydrogenated naphtha, hydrogenated diesel oil and hydrogenated residue;

The feedstock oil for the residue hydrotreating unit is a mixture of residue, catalytic cracking recycle oil and optional distillate oil. The content of the catalytic cracking recycle oil in the mixed feedstock oil of said catalytic cracking recycle oil and optional the residue and/or distillate oil is 3-50% by weight. Said catalytic cracking recycle oil is one or more selected from the group consisting of heavy cycle oil, decanted oil or all catalytic cracking slurry oil remained after separating off catalytic cracking diesel oil.

The feedstock oil of the residue hydrotreating unit may also be a mixture of residue, catalytic cracking heavy cycle oil with acidic solid impurity being removed, optional distillate oil and optional distillate of catalytic cracking slurry oil. The catalytic cracking heavy cycle oil from which the acidic solid impurity is removed accounts for 3%~50% by weight of the feedstock oil of the residue hydrotreating unit. Said catalytic cracking heavy cycle oil may be heavy cycle oil from any catalytic cracking unit. Said residue is vacuum residuum and/or atmospheric residuum. Said distillate oil is one or more selected from the group consisting of coking gas oil, deasphalted oil, vacuum gas oil or extract oil from solvent refining. These distillate oils may be added into the residue as feedstock of the residue hydrotreating unit to carry out hydrotreating, also may be feedstock of other units instead of addition to the residue. Said distillate of the catalytic cracking slurry oil has a boiling range of 400~500° C. and, accounts for 15%~80% by weight of full fraction of the catalytic cracking slurry oil.

Reaction conditions of said residue hydrotreating are: a hydrogen partial pressure of 5.0~22.0 MPa, a reaction temperature of 330~450° C., a volume space velocity of 0.1~3.0 $hrs^{-1}$ and a $H_2$/Oil volume ratio of 350~2000 $Nm^3/m^3$.

Active metal constituents of said residue hydrogenation catalyst are selected from the group consisting of VIB Group metals and/or VIII Group non-noble metals, and a substrate is one or more selected from the group consisting of alumina, silica and amorphous silica-alumina. The metal component is preferably a combination of nickel-tungsten, nickel-tungsten-cobalt, nickel-molybdenum or cobalt-molybdenum.

The residue hydrotreating unit may be one or more set of unit, each of which comprises at least a reactor and a fractionator. The hydrogenation reactor is usually fixed-bed reactor, also may be moving-bed reactor or ebullient bed reactor.

Among the reaction products of the residue hydrotreating, the gas may be used as a feedstock of hydrogen manufacture or a refinery gas, the hydrogenated naphtha may be used as a feedstock of catalytic reforming unit or ethylene production unit by steam cracking, the hydrogenated diesel oil is a desirable blending component of diesel oil product, and the hydrogenated residue has a boiling range of >350° C., and all of which can be used as a feedstock of catalytic cracking unit.

(2) Step for Catalytic Cracking

The hydrogenated residue obtained from step (1) and optional vacuum gas oil are fed into catalytic cracking unit to carry out cracking reaction in the presence of catalytic cracking catalyst, and the reaction products are separated to obtain dry gas, liquefied gas, catalytic cracking gasoline, catalytic cracking diesel oil, catalytic cracking heavy cycle oil and catalytic cracking slurry oil.

The feedstock oil of the catalytic cracking unit is the hydrogenated residue obtained from step (1) and optional vacuum gas oil (VGO), wherein the hydrogenated residue has a boiling point range >350° C. The catalytic cracking unit may be one or more set of unit, each of which comprises at least a reactor, a regenerator and a fractionator. The catalytic cracking reactor is generally a riser reactor, or a combination of a riser and a bed reactor. Said catalytic cracking unit may be a set or several sets of units of a family of catalytic cracking, such as heavy oil fluidized catalytic cracking (RFCC), catalytic cracking (DCC), catalytic cracking for high production of isoalkane (MIP) and the like.

Said cracking reaction conditions are: a reaction temperature of 470~650° C., a reaction time of 0.4~5 second, a weight ratio of catalyst to feedstock oil of 3~10, and a regeneration temperature of 650~800° C.

Said catalytic cracking catalyst comprises zeolite, inorganic oxide and optional clay, in an amount of 5~50 wt % of zeolite, 5~95 wt % of inorganic oxide, and 0~70 wt % of clay.

Said zeolite acts as an active component and is one selected from the group consisting of macropore zeolite and optional mesopore zeolite, wherein the macropore zeolite accounts for 25~100 wt %, preferably 50~100 wt %, of the active component, the mesopore zeolite accounts for 0~75 wt %, preferably 0~50 wt % of the active component.

Said macropore zeolite is a mixture of one of more zeolites selected from the group consisting of Y-type zeolite, rare earth Y-type zeolite (REY), rare earth HY-type zeolite (REHY), ultrastable Y-type zeolite (USY), rare earth ultrastable Y-type zeolite (REUSY).

Said mesopore zeolite is one selected from the group consisting of ZSM serial zeolites and/or ZRP serial zeolites, and may be modified by using non-metallic element such as phosphor and the like and/or transition metal elements such as iron, cobalt, nickel and the like. ZSM serial zeolite is a mixture having one or more zeolites selected from the group consisting of ZSM-5, ZSM-11 ZSM-12, ZSM-23, ZSM-35, ZSM-38, ZSM-48 and other zeolites having similar structure.

Said inorganic oxide acts as an adhesive agent, and is one selected from the group consisting of silica ($SiO_2$) and/or alumina ($Al_2O_3$).

Said clay acts as a matrix i.e. substrate, is selected from the group consisting of kaolin and/or halloysite.

Among the products obtained from catalytic cracking unit: catalytic cracking gasoline is a desirable blending component for gasoline product; catalytic cracking diesel oil can be added directly into diesel oil product if it has a high enough cetane number, or is required to be hydrotreated to increase its cetane number; the catalytic cracking heavy cycle oil may be circulated to the residue hydrotreating unit to be treated further after being removed off acidic solid impurity; catalytic cracking slurry oil may be directly discharged out of the unit, and may be separated by distilling to obtain distillate, which may be circulated directly, or after finely filtered to the residue hydrotreating unit, and residue.

(3) Step for Removing the Acidic Solid Impurity

In the present application, the term of "acidic solid impurity" represents the particulate fine powder of catalytic cracking catalyst entrained by oil and gaseous product into the main fractionator during catalytic cracking. The particulate fine powder may be suspended mainly in the catalytic cracking heavy cycle oil and slurry oil distillate because of viscosity character of oil products. Catalytic cracking catalyst is composed of active component-molecular sieve, substrate and other adjuvant components. Due to the B-acid (Brönsted acid) and L-acid (non Brönsted acid) centers located on the catalyst, the catalyst fine powder exhibits a proper acid character, and thus can be called as acidic solid impurity.

According to the common knowledge in the art, the solid impurity particulate substance contained in the feedstock oil that enters the fixed-bed hydrogenation reactor, the particulate substance may pass through the bed of residue hydrogenation catalyst without forming pressure drop (see: "Improvement of Feedstock Filter in Residue Hydrogenation Unit", by Mu Haitao and Sun Zhenguang, "Refining Design", Vol. 31, No. 5, 2001) when its size is less than or equal to 25 μm. Therefore, the solid impurity contained in the residue is usually controlled to have a particle size of not greater than 25 μm during the reaction of customary residue hydrotreating. However, the inventor of the present invention found that the solid particulate substance contained in the catalytic cracking recycle oil has a deterioration effect on the steady operation of the hydrotreating unit even with a particle size of less than 25 μm (e.g., less than 14 μm) when the feedstock oil introduced into the hydrotreating reaction unit contains catalytic cracking recycle oil. It shows that this kind of negative effect is closely related to the content of the solid substance and particle size of the solid particulates in the catalytic cracking recycle oil.

Therefore, the process according to the present invention comprises further a step for removing the acidic solid substance from the catalytic cracking recycle oil before contacting the residue, the catalytic cracking recycle oil and optional distillate oil with the hydrotreating catalyst, which step makes the acidic solid substance is reduced to a content of less than 30 ppm with a particle size of less than 10 μm in the catalytic recycle oil, preferably a content of less than 15 ppm with a particle size of less than 5 μm, especially preferably a content of less than 5 ppm with a particle size of less than 2 μm. Aforesaid particle size is measured with laser light scattering particle size analyzer. Since the acidic solid particulates have a distribution range of particle size, the particle size used herein all represents a value of d(0.8), wherein the value of d(0.8) is defined as that 80 v % of solid particulates in the measured sample have particle size all less than the value.

Additionally, the acidic solid impurity may be removed from the catalytic cracking heavy cycle oil obtained from step (2), and the catalytic cracking heavy cycle oil from which acidic solid impurity has been removed can be circulated to the residue hydrotreating unit.

The catalytic cracking heavy cycle oil with the acidic solid impurity being removed has less than 30 ppm acidic solid impurity with a particle size of less than 10 micrometer, preferably less than 15 ppm acidic solid impurity with a particle size of less than 5 micrometer particle size, more preferably less than 5 ppm acidic solid impurity with a particle size of less than 2 micrometer. Aforesaid particle size is measured with laser light scattering particle size analyzer. Since the acidic solid particulates have a distribution range of particle size, the particle size used herein all represents a value of d(0.8), wherein the value of d(0.8) is defined as that 80 v % of solid particulates in the measured sample have particle size all less than the value.

Said catalytic cracking recycle oil or catalytic cracking heavy cycle oil is processed by using a combination of one or more methods selected from the group consisting of fine filtration, centrifugation, distillation or flash separation to remove the acidic solid impurity. The catalytic cracking recycle oil or catalytic cracking heavy cycle oil is preferably processed by using fine filtration to remove the acidic solid impurity, because the fine filtration method has higher efficiency and lower cost for running.

Fine filtration is a speaking relative to a common filtration. It uses a filter with the pore diameter of filter element being 0.1~5 micrometer, preferably 0.5~2 micrometer. The filter element of the filter is a sintered plate of metal powder, a sintered web of metal wire, or other materials. It is able to reduce the filtered solid particulate substance to have a particle size of less than 10 micrometer with a content of less than 30 ppm, preferably a particle size of less than 5 micrometer with a content of less than 15 ppm, more preferably, a particle size of less than 2 micrometer with a content of less than 5 ppm. Aforesaid particle size is measured with laser light scattering particle size analyzer. Since the acidic solid particulates have a distribution range of particle size, the particle size used herein all represents a value of d(0.8), wherein the value of d(0.8) is defined as that 80 v % of solid particulates in the measured sample have particle size all less than the value.

Since filtration effect is very closely related to the viscosity of catalytic cracking recycle oil or catalytic cracking heavy cycle oil, the filtration is carried out at a higher temperature to decrease viscosity of the catalytic cracking recycle oil or catalytic cracking heavy cycle oil. The filtration temperature is 100~350° C., preferably 200~320° C. when the fine filtration is used for removing the acidic solid impurity from said catalytic cracking recycle oil or catalytic cracking heavy cycle oil.

Centrifugation uses centrifuging to separate out the most part of catalyst powder in the catalytic cracking recycle oil or catalytic cracking heavy cycle oil. The treated catalytic cracking recycle oil or catalytic cracking heavy cycle oil contains the acidic solid impurity with a particle size of less than 10 micrometer and a content of less than 30 ppm, preferably a particle size of less than 5 micrometer and a content of less than 15 ppm, more preferably a particle size of less than 2 micrometer and a content of less than 5 ppm.

Distillation or flash separation separates out the most part of catalyst powder by distilling or flashing. The distilled catalytic cracking recycle oil or distilled catalytic cracking heavy cycle oil contains the acidic solid impurity having a particle size of less than 10 micrometer and a content of less than 30 ppm, preferably a particle size of less than 5 micrometer and a content of less than 15 ppm, more preferably a particle size of less than 2 micrometer and a content of less than 5 ppm. Heavy component of the catalyst particulate substance enriched at the bottom of distillation tower or flash tank may be collected together into the catalytic cracking slurry oil or returned back to a catalytic cracking riser to carry out cracking reaction again.

(4) The catalytic cracking recycle oil or catalytic cracking heavy cycle oil obtained from step (3), from which the acidic solid impurity is removed, is circulated to the residue hydrotreating unit.

Residue hydrotreating is a diffusion-dependent reaction, and thus the viscosity is an essential factor that influences hydrotreating reaction of the residue, especially, the vacuum residuum with high viscosity. Addition of the catalytic cracking recycle oil, especially catalytic cracking heavy cycle oil, results in decreasing viscosity of the feedstock for residue hydrotreating, increasing diffusion rate of residue molecules into micropores of the catalyst, and thereby accelerating hydrodemetallization reaction of impurities such as metal and the like. In addition, in contrary with hydrogenation unit of distillate oil, the residue hydrotreating unit has serious carbon deposit at the tail end of the catalyst bed, furthermore, the more close to outlet of the reactor, the more carbon deposit is formed. This is primarily in that colloid and oil constituents have a fast hydrogenating-saturation speed, while asphaltine has a slow hydrogenating-saturation speed and is easy to breaks off side chains with only aromatic nuclei with the highest aromaticity remaining. Therefore, the solubility becomes less and less in the environmental solvent of which saturation degree becomes higher and higher, and finally carbon deposit is easy to be formed on the catalyst by settling. If catalytic cracking recycle oil having high aromaticity is added, especially a catalytic cracking heavy cycle oil, the aromaticity of ambient solvent may be increased, peptizing power of asphaltine may be increased, and deposition on the catalyst at tail end of the bed can be decreased. In addition, partially hydrogenated products of polycyclic aromatics in the catalytic cracking recycle oil, especially in the heavy cycle oil are very strong hydrogen-donators that are able to decrease condensation of thermal free radical of the residue and suppress the formation of coking precursor. These all can greatly decrease carbon deposit on catalyst, reduce deactivation rate and elongate operation cycle.

Therefore, the catalytic cracking recycle oil, especially the catalytic cracking heavy cycle oil, from which solid acidic particulate substance has been removed, is circulated to the residue hydrotreating unit and treated before being used as a catalytic cracking feedstock. As a result, the detrimental effect brought along with the solid acidic particulate substance is eliminated, inherent properties of ability peptizing asphaltine and the like are maintained, and improvement of running all the residue hydrotreating unit and catalytic cracking unit is brought about.

The inventor recognizes that, although particles of the catalytic cracking catalyst are very fine themselves, coke forming around catalyst particulate may envelope the catalyst due to strong acidity of the particulate substance of catalytic cracking catalyst, making the particulate diameter becoming larger, such that the particulate substance cannot pass through the bed of residue hydrogenation catalyst and forms accumulation in the bed of residue hydrogenation catalyst. This may result in blocking the bed of residue hydrogenation catalyst and increasing pressure drop. On the other hand, contrary to the common knowledge that only self-coking occurs on these catalytic cracking catalysts having strong acidity, the inventor further recognizes that it is even more seriously that these catalytic cracking catalysts may make residue asphaltine cracked and decomposed to form some activated coking precursors, and these detrimental materials may further make residue hydrotreating catalyst coked seriously at tail end of the bed, affecting activities of the residue hydrotreating catalyst for hydrodesulfurization, hydrodenitrogenation and hydrodecoking, and further may result in varying product of residue hydrotreating to be poor in quality and affecting lifetime of the hydrotreating catalyst and shortening operation cycle of the unit. Accumulation of the catalytic cracking catalyst in hydrogenation catalyst bed may even make these effects more serious. Based on the cognitions on the two sides, before catalytic cracking recycle oil or catalytic cracking heavy cycle oil enters the residue hydrotreating reactor, the catalytic cracking catalyst powder therein must be removed off as possible.

(5) Step for Separation of Catalytic Cracking Slurry Oil by Distilling

Catalytic cracking slurry oil remained after catalytic cracking diesel oil is separated out or said the catalytic cracking slurry oil obtained from step (2) may be discharged directly from the unit. Alternatively, said catalytic cracking slurry oil is separated by distilling, if the distillate obtained from the catalytic cracking slurry oil satisfies the following condition: the acidic solid impurity contained has a particle size of less than 10 micrometer with a content of less than 30 ppm, preferably a particle size of less than 5 micrometer with a content of less than 15 ppm, more preferably a particle size of less than 2 micrometer with a content of less than 5 ppm, it may be circulated directly to the residue hydrotreating unit. If not, the distillate of catalytic cracking slurry oil may be processed by a separation step, for example step (3), and then circulate to the residue hydrotreating unit.

After the catalytic cracking slurry oil is separated by distilling and the distillate and residue are obtained, the distillate of the slurry oil has a boiling range of 400~500° C., the distillate of catalytic cracking slurry oil accounts for 15%~80% by weight of full fraction of the catalytic cracking slurry oil. The residue of the slurry oil has a boiling range depending upon yield of the distillate, generally higher than 480° C., the residue accounts for 20%~85% by weight of full fraction of the catalytic cracking slurry oil, the residue may be used as a blending component of fuel oil or road asphalt.

THE PRESENT INVENTION HAS ADVANTAGES AS FOLLOWS

1. The process according to the present invention can make the catalytic cracking recycle oil, especially the catalytic cracking heavy cycle oil before entering the residue hydrotreating unit to remove out the catalytic cracking catalyst powder, avoiding disadvantageous factors brought about with the catalytic cracking catalyst to the residue hydrotreating unit, including decreasing down the reaction effectiveness of residue hydrotreating and shortening operation cycle of the residue hydrotreating, and make a more effective combination of hydrotreating and catalytic cracking of residue able to be realized.

2. Adding catalytic cracking recycle oil, especially catalytic cracking heavy cycle oil, from which catalyst particulate substance is removed, to the residue, in particularly vacuum residuum, may result in decreasing feedstock viscosity in a large amplitude, increasing reactant diffusivity and reaction rate of removing impurity, and decreasing the content of sulfur, nickel and vanadium in formation oil, or increased greatly the feedstock space velocity provided that properties of the hydrogenating formation oil are ensured from variation. Meanwhile, carbon deposit may be further suppressed on the hydrogenation catalyst, activity of the residue hydrotreating catalyst is increased, and operation cycle of the residue hydrotreating unit is elongated.

3. After the catalytic cracking recycle oil, especially catalytic cracking heavy cycle oil, is hydrogenated, its sulfur content may be decreased, so the sulfur content of its catalytic cracking gasoline and diesel oil may be decreased; after the catalytic cracking heavy cycle oil is hydrogenated, its saturation degree and hydrogen content may be increased, so yield of light oil (here represents the sum of liquefied gas, gasoline and diesel oil) is increased, displaying as increased in yield of hydrogenated diesel oil and catalytic cracking light oil; meantime, coking quantity of catalytic cracking is decreased, treatment capacity of the catalytic cracking unit is increased.

ILLUSTRATION OF ACCOMPANYING DRAWING

Attached drawing is a schematic diagram of the combined process according to the present invention for hydrotreating and catalytic cracking of residue.

SPECIFIC EMBODIMENTS

The following is intended to illustrate the process according to the present invention in combination with the attached drawing, but not limit the present invention thereby.

The attached drawing is a schematic diagram of the combined process according to the present invention for hydrotreating and catalytic cracking of residue.

Residue from line 1 and catalytic cracking heavy cycle oil from which acidic solid impurity has been removed from line 21 are mixed with optional distillate oil from line 20 and optional distillate from catalytic cracking slurry oil, then are fed into residue hydrotreating unit 3 together with hydrogen gas from line 2 to carry out hydrotreating reaction in the presence of hydrogenation catalysts; the products of the hydrogenating reaction are separated to obtain gas, hydrogenated naphtha, hydrogenated diesel oil and hydrogenated residue, wherein gas, hydrogenated naphtha and hydrogenated diesel oil are discharged out from the unit via line 4, 5 and 6 respectively; the hydrogenated residue from line 7 and optional vacuum gas oil from line 8 are fed into catalytic cracking unit 10 via line 9 to carry out reaction in the presence of catalytic cracking catalyst; the reaction products of catalytic cracking are separated to obtain dry gas, liquefied gas, catalytic cracking gasoline, catalytic cracking diesel oil, catalytic cracking heavy cycle oil and catalytic cracking slurry oil, wherein the dry gas, liquefied gas, catalytic cracking gasoline and catalytic cracking diesel oil are discharged out from the unit via lines 11, 12, 13 and 14 respectively; the catalytic cracking heavy cycle oil is fed into fine filter 22 via line 15 to remove acidic solid impurity, heavy cycle oils from other catalytic cracking unit are fed sequentially into the fine filter 22 via lines 25 and 15 to remove the acidic solid impurity, the catalytic cracking heavy cycle oil with the acidic solid impurity being removed out is circulated to residue hydrotreating unit 3 via line 21; the catalytic cracking slurry oil may be drawn out from the unit via line 26 or is fed into distilling apparatus 17 via line 16, the residue separated from distilling apparatus 17 is drawn out from the unit via line 18, the distillate of catalytic cracking slurry oil may be fed into residue hydrotreating unit 3 sequentially via lines 19 and 24, also may be fed into fine filter 22 sequentially via lines 19 and 23 to remove the acidic solid impurity, then are circulated to residue hydrotreating unit 3 together with the catalytic cracking heavy cycle oil from which the acidic solid impurity has been removed.

The following examples are intended to illustrate further the process according to the present invention, but not limit the present invention thereby.

The residue hydrotreating test was carried out in a pilot-plant with twin-tube reactor in the examples and comparative examples, the first reactor (abbreviated as reactor 1) was loaded with hydrogenated protective catalyst and hydrodemetallization catalyst, and the second reactor (abbreviated as reactor 2) was loaded with hydrodesulfurization catalyst, a ratio of the three kinds of catalysts was 5:45:50, wherein the hydrogenated protective hcatalysts, hydrodemetallization catalyst and hydrodesulfurization catalyst have respectively commercial trademark as RG-10A, RDM-2, and RMS-1, manufactured by Changling Catalyst Plant of Catalyst Branch of SINO Petrochemical Corp. The catalytic cracking test was carried out in a pilot-plant with a small scale of riser reactor in Examples and Comparative Examples, the catalytic cracking catalyst used was the same one with commercial trademark as LV-23, manufactured by Catalyst Plant of Lanchow Branch of SINO Petroleum Grouping Corp. In the catalytic cracking test, the heavy oil therein represents catalytic cracking heavy cycle oil and catalytic cracking slurry oil.

COMPARATIVE EXAMPLE 1

An atmospheric residuum was used as feedstock oil A, a catalytic cracking heavy cycle oil (HCO) was used as feedstock oil B (comprising 83 ppm of acidic solid impurity having a particle size of 14 micrometer), whose properties are shown in Table 1. Feedstock oil A and hydrogen were mixed, then contacted with hydrogenation catalysts to carry out hydrotreating reaction. The reaction products were separated to obtain gas, hydrogenated naphtha, hydrogenated diesel oil and hydrogenated tail oil. The hydrogenated tail oil obtained and feedstock B were mixed in a mass ratio of 87.9:10 as catalytic cracking feedstock feeding into the catalytic cracking unit to carry out reaction, and the reaction products were separated to obtain the corresponding products, wherein reaction conditions of the residue hydrotreating, a distribution of residue hydrogenated products, and properties of the hydrogenated residue are shown in Table 2, and catalytic cracking reaction conditions and a distribution of catalytic cracking products are shown in Table 3.

EXAMPLE 1

Feedstock oil B was finely filtered (at a filtration temperature of 230° C.) to decrease the content of acidic solid impurity from 83 ppm before the filtration to 7 ppm and the particle size from 14 micrometer to 1.5 micrometer. A mixture of feedstock oil A and feedstock oil B from which acidic solid impurity has been removed was used as feedstock oil C with the main properties being shown in Table 1, wherein feedstock oil B from which acidic solid impurity has been removed accounted for 9.1% by weight of the feedstock oil of the residue hydrotreating unit. The feedstock oil C was used as a feedstock of residue hydrotreating unit, and contacted with hydrogenation catalysts to carry out hydrotreating reaction after being mixed with hydrogen. The reaction products were separated to obtain gas, hydrogenated naphtha, hydrogenated diesel oil and hydrogenated tail oil. The hydrogenated tail oil obtained as a catalytic cracking feedstock was fed into the catalytic cracking unit to carry out reaction, and the reaction products obtained were separated to obtain corresponding products, wherein reaction conditions of the residue hydrotreating, a distribution of residue hydrogenated products and properties of the hydrogenated residue are shown in Table 2, and catalytic cracking reaction conditions and a distribution of catalytic cracking products are shown in Table 3.

It can be seen from the data shown in Table 2 that the contents of the impurities such as sulfur, carbon residue, metal and the like in the hydrogenated residue obtained are all less than those of the hydrogenated residue obtained in Comparative Example 1 when the space velocity of Example 1 is increased by 10% higher than that of Comparative Example 1. Especially the metal content is even more less than that of dilution effect formed by blending with heavy cycle oil, showing that incorporating the residue into the catalytic cracking heavy cycle oil from which the acidic solid impurity has been removed before the hydrogenation facilitated the reactions such as hydrodemetallization and the like. Furthermore, the yield of the hydrogenated diesel oil obtained in Example 1 was increased by 0.4% than that obtained in Comparative Example 1.

It can be seen from the data shown in Table 3 that total yield of high value of catalytic cracking products (gasoline, diesel oil and liquefied gas) obtained in Example 1 is 1.66% higher than that obtained in Comparative Example 1, the coke yield is 0.31% less than that obtained in Comparative Example 1, and the yield of the catalytic cracking heavy oil is 1.37% less than that obtained in Comparative Example 1. These results show that the process used in the present invention considerably increase the yield of valuable products as compared with the residue hydrogenation unit or catalytic cracking unit.

TABLE 1

| | Feedstock oil | | |
|---|---|---|---|
| | Feedstock oil A | Feedstock oil B | Feedstock oil C |
| Density (20° C.), g/cm$^3$ | 0.965 | 0.998 | 0.968 |
| Viscosity (100° C.)mm$^2$/S | 43.10 | 6.235 | 34.35 |
| Carbon residue wt % | 9.81 | 0.3 | 8.86 |
| S, wt % | 3.2 | 0.65 | 2.9 |
| N, wt % | 0.20 | 0.18 | 0.20 |
| Ni, ppm | 10.5 | / | 9.5 |
| V, ppm | 37.6 | / | 33.8 |
| Asphaltine, wt % | 3.6 | / | 3.3 |

TABLE 2

| | Comparative Example 1 | Examples 1 |
|---|---|---|
| Feedstock oil | Feedstock oil A | Feedstock oil C |
| Reaction conditions | | |
| Hydrogen partial pressure, MPa | 13.0 | 13.0 |
| Volume space velocity, h$^{-1}$ | 0.25 | 0.275 |
| Reaction temperature, ° C. | 380 | 380 |
| H/O volume ratio, Nm$^3$/m$^3$ | 650 | 650 |
| Distribution of residue hydrogenated products, wt % | | |
| $H_2S + NH_3$ | 3.17 | 2.90 |
| $C_1$~$C_4$ | 1.48 | 1.45 |
| Hydrogenated naphtha (C5~180° C.) | 0.95 | 0.95 |
| Hydrogenated diesel oil (180° C.~350° C.) | 6.5 | 6.9 |
| Hydrogenated residue (>350° C.) | 87.9 | 87.8 |
| Properties of hydrogenated residue | | |
| Density (20° C.)(g/cm$^3$) | 0.922 | 0.925 |
| Carbon residue, wt % | 3.9 | 3.5 |

TABLE 2-continued

| | Comparative Example 1 | Examples 1 |
|---|---|---|
| S, wt % | 0.30 | 0.27 |
| N, wt % | 0.16 | 0.15 |
| Ni + V, ppm | 5.0 | 3.8 |

TABLE 3

| | Comparative Example 1 | Example 1 |
|---|---|---|
| Reaction conditions of catalytic cracking | | |
| Catalyst-oil ratio | 6 | 6 |
| Reaction temperature, ° C. | 502 | 502 |
| Reaction time, s | 2 | 2 |
| Product distribution of catalytic cracking, wt % | | |
| Dry gas | 1.60 | 1.62 |
| Liquefied gas | 11.58 | 11.78 |
| Catalytic cracking gasoline | 47.08 | 48.33 |
| Catalytic cracking diesel oil | 20.12 | 20.33 |
| Heavy oil | 12.32 | 10.95 |
| Coke | 7.30 | 6.99 |

COMPARATIVE EXAMPLE 2

A mixed oil of a vacuum residuum with a vacuum gas oil was used as feedstock oil D, wherein a mass ratio of the vacuum residuum to the vacuum gas oil was 95:5. A vacuum gas oil was used as feedstock oil E. Essential properties of feedstock oil D and feedstock oil E are shown in Table 4. Vacuum flashing of catalytic cracking slurry oil was carried out, and <470° C. distillate obtained from the top of the flash tower was used as feedstock oil S with properties shown in Table 4. Feedstock oil D was mixed with hydrogen gas, then contacted with hydrogenation catalysts to carry out hydrotreating reaction, and the reaction products were separated to obtain gas, hydrogenated naphtha, hydrogenated diesel oil and hydrogenated tail oil. The hydrogenated tail oil obtained and feedstock B, feedstock S and feedstock E were mixed in a mass ratio of 82.2:18:2:30 and was fed into the catalytic cracking unit to carry out reaction as a catalytic cracking feedstock. The reaction products were separated to obtain corresponding products, wherein reaction conditions of the residue hydrotreating, a distribution of residue hydrogenated products and properties of hydrogenated residue are shown in Table 5, and catalytic cracking reaction conditions and a distribution of catalytic cracking products are shown in Table 6.

EXAMPLE 2

A catalytic cracking slurry oil was vacuum flashed, and <470° C. distillate obtained from the top of flash tower was used as feedstock oil S. Feedstock oil S and feedstock oil B were combined together, then fine filtered at a filtering temperature of 230° C., wherein the content of the acidic solid impurity was decreased from 123 ppm before filtering to 10 ppm, and the particle size was decreased from 16 micrometer to 2 micrometer. Feedstock oil D, feedstock oil B from which the acidic solid impurity has been removed and distillate S of the slurry oil from which the acidic solid impurity has been removed were mixed together as feedstock oil F with main properties being shown in Table 4, wherein feedstock oil B from which the acidic solid impurity has been removed accounted for 15.0% by weight of feedstock oil F of the residue hydrotreating unit, the distillate S of the slurry oil from which the acidic solid impurity has been removed accounted for 1.7% by weight of feedstock oil F of the residue hydrotreating unit. Feedstock oil F was used as a feedstock of the residue hydrotreating unit. Feedstock oil F was mixed with hydrogen, then contacted with hydrogenation catalysts to carry out hydrotreating reaction, and the reaction products were separated to obtain gas, hydrogenated naphtha, hydrogenated diesel oil and hydrogenated tail oil. The hydrogenated tail oil obtained and feedstock oil E were mixed in a mass ratio 98.76:30 and fed into the catalytic cracking unit as a catalytic cracking feedstock to carry out reaction, and the reaction products were separated to obtain corresponding products, wherein reaction conditions of the residue hydrotreating, a product distribution of the residue hydrogenating and properties of the hydrogenated residue are shown in Table 5, and catalytic cracking reaction conditions and a product distribution of catalytic cracking are shown in Table 6.

It can be seen from the data shown in Table 5 that in the case of that the space velocity of Example 2 is increased by 20% higher than that of Comparative Example 2, the contents of impurities such as sulfur, carbon residue, metal and the like of the hydrogenated residue obtained are all less than those of hydrogenated residue obtained in Comparative Example 2, especially metal content is even more less than that of the dilution result obtained by blending with heavy cycle oil. It shows that incorporating the residue into the catalytic cracking heavy cycle oil from which the acidic solid impurity has been removed before the hydrogenation facilitated the reactions such as hydrodemetallization and the like. Furthermore, the yield of hydrogenated diesel oil obtained in Example 2 is increased by 0.7% higher than that in Comparative Example 2. It can be seen from the data as shown in Table 6 that the total yield of high value of catalytic cracking products (gasoline, diesel oil and liquefied gas) obtained in Example 2 is 3.12% higher than that obtained in Comparative Example 2, and the coke yield is 0.59% less than that obtained in Comparative Example 2 and the yield of catalytic cracking heavy oil is 2.52% less than that obtained in Comparative Example 2. These results show that the process used in the present invention considerably increase the yield of valuable products as compared with either the residue hydrogenation unit or catalytic cracking unit.

TABLE 4

| | Feedstock oil D | Feedstock oil S | Feedstock oil E | Feedstock oil F |
|---|---|---|---|---|
| Density (20° C.) ($g/cm^3$) | 0.999 | 1.011 | 0.919 | 1.000 |
| Viscosity (100° C.), $mm^2/S$ | 701.5 | 9.372 | 5.756 | 181.6 |
| Residue coke, wt % | 18.0 | 0.2 | / | 15.1 |
| S, wt % | 4.58 | 0.88 | 0.41 | 3.92 |
| Ni, ppm | 28.1 | / | / | 22.5 |
| V, ppm | 79.7 | / | / | 63.8 |

TABLE 4-continued

| | Feedstock oil D | Feedstock oil S | Feedstock oil E | Feedstock oil F |
|---|---|---|---|---|
| C7 undissolved substance, wt % | 5.6 | / | / | 4.5 |

TABLE 5

| | Comparative Example 2 | Example 2 |
|---|---|---|
| Feedstock oil | Feedstock oil D | Feedstock oil F |
| Reaction conditions | | |
| Hydrogen partial pressure, MPa | 15.5 | 15.5 |
| Volume space velocity, $h^{-1}$ | 0.18 | 0.216 |
| Reaction temperature, ° C. | 390 | 390 |
| H/O volume ratio, $Nm^3/m^3$ | 750 | 750 |
| Distribution of residue hydrogenated products, wt % | | |
| $H_2S + NH_3$ | 4.60 | 3.85 |
| $C_1$~$C_4$ | 2.03 | 1.96 |
| Hydrogenated naphtha (C5~180° C.) | 1.37 | 1.39 |
| Hydrogenated diesel oil (180° C.~350° C.) | 9.8 | 10.5 |
| Hydrogenated residue (>350° C.) | 82.2 | 82.3 |
| Properties of hydrogenated residue | | |
| Density(20° C.), $g/cm^3$ | 0.943 | 0.947 |
| Residue coke, wt % | 7.3 | 6.0 |
| S, wt % | 0.54 | 0.47 |
| Ni + V, ppm | 16.7 | 11.7 |

TABLE 6

| | Comparative Example 2 | Example 2 |
|---|---|---|
| Reaction conditions of catalytic cracking | | |
| Catalyst-oil ratio | 7.5 | 7.5 |
| Reaction temperature, ° C. | 520 | 520 |
| Reaction time, s | 2 | 2 |
| Distribution of catalytic cracking products, wt % | | |
| Dry gas | 1.65 | 1.64 |
| Liquefied gas | 10.59 | 10.94 |
| Catalytic cracking gasoline | 43.01 | 46.05 |
| Catalytic cracking diesel oil | 15.28 | 15.01 |
| Heavy oil | 20.57 | 18.05 |
| Coke | 8.90 | 8.31 |

COMPARATIVE EXAMPLE 3

The present Comparative Example was a test for the effect of accumulating catalytic cracking catalyst in the residue hydrogenation catalyst on the hydrogenating reaction of residue. Feedstock oil B having 83 ppm of particulate of the catalytic cracking catalyst with a particle size of 14 micrometer was mixed with atmospheric residuum feedstock A in a mass ratio of 25:75 as residue hydrogenating feedstock. Properties of feedstock oil A and feedstock oil B are shown in Table 1. Hydrogenating reaction conditions were: a hydrogen pressure of 13.0 Mpa, a volume space velocity of 0.30 $h^{-1}$, a hydrogen-to-oil ratio of 800 $Nm^3/m^3$, a reaction temperature of 370° C. in the first 1000 hrs, and 380° C. in the subsequent 2000 hrs, then 390° C. in the last 2000 hrs. After the test was carried out for 5000 hrs, the hydrogenated formation oil has properties shown in Table 7. Catalytic cracking test of the hydrogenated formation oil was carried out with test conditions and results being shown in Table 8.

EXAMPLE 3

Catalyst used for the hydrogenating test in the present Example was the same as that used in hydrogenation test of Comparative Example 3. Feedstock oil B was processed by fine filtration at a filtering temperature of 230° C. and then contained 7 ppm of the catalytic cracking catalyst with a particle size of less than 1.5 micrometer. Hydrogenating feedstock oil was a mixed oil of finely filtered feedstock oil B and atmospheric residuum in a mass ratio of 25:75. Hydrogenating reaction was carried out under the same reaction conditions as that in Comparative Example 3: a hydrogen pressure of 13.0 MPa, a volume space velocity of 0.30 $h^{-1}$, a hydrogen-to-oil ratio of 800 $Nm^3/m^3$, a reaction temperature of 370° C. in the first 1000 hrs, 380° C. in the subsequent 2000 hrs, and 390° C. in the last 2000 hrs. After the test was carried out for 5000 hrs, the formation oil obtained in hydrogenating has properties shown in Table 7. Catalytic cracking test of the hydrogenated formation oil was carried out with test conditions and results being shown in Table 8.

It can be seen from Table 7 that the hydrogenated formation oil in Comparative Example 3 has 0.50 wt % sulfur content and 4.3 wt % carbon residue, while the hydrogenated formation oil in Example 3 has 0.40 wt % sulfur content and 3.8 wt % carbon residue, superior to that in Comparative Example 3. It shows that the solid acidic particulate existing in the catalytic cracking heavy cycle oil is disadvantageous to long-time cycle reaction of the residue hydrogenating. However, the hydrogenation catalyst can be significantly improved the long-time cycle operation of the residue hydrogenating with higher activity after the acidic solid particulate is removed. Table 8 shows the benefits brought along with removing off the acidic solid particulate substance: the yield of valuable products of catalytic cracking, i.e. gasoline+diesel oil+liquefied gas is 2% higher than that in the Comparative Example, and the coke yield is decreased. These results show that adding a fine filter of catalytic cracking heavy cycle oil to remove off catalytic cracking catalyst powder from the catalytic cracking heavy cycle oil is highly essential to maintain the activity of hydrogenation catalyst in long-time cycle operation.

TABLE 7

| Properties of hydrogenated residue | | |
|---|---|---|
| | Comparative Example 3 | Example 3 |
| Density (20° C.), $g/cm^3$ | 0.938 | 0.932 |
| Residue Carbon, wt % | 4.3 | 3.8 |

TABLE 7-continued

| Properties of hydrogenated residue | | |
|---|---|---|
| | Comparative Example 3 | Example 3 |
| S, wt % | 0.50 | 0.40 |
| Ni + V, ppm | 4.4 | 4.1 |

TABLE 8

| Catalytic cracking reaction conditions and product distribution | | |
|---|---|---|
| | Comparative Example 3 | Example 3 |
| Reaction conditions of catalytic cracking | | |
| Catalyst-oil ratio | 6.5 | 6.5 |
| Reaction temperature, ° C. | 510 | 510 |
| Reaction time, s | 2 | 2 |
| Product distribution of catalytic cracking, wt % | | |
| Dry gas | 1.63 | 1.67 |
| Liquefied gas | 10.51 | 10.73 |
| Catalytic cracking gasoline | 43.88 | 45.13 |
| Catalytic cracking diesel oil | 19.33 | 19.92 |
| Heavy oil | 16.90 | 15.05 |
| Coke | 7.75 | 7.50 |

COMPARATIVE EXAMPLE 4

The present Comparative Example is a test for the effect of accumulated catalytic cracking catalyst in the residue hydrogenation catalyst on the hydrogenating reaction of residue. Feedstock oil B having 83 ppm catalytic cracking catalyst particulate substance with a particle size of 14 micrometer was mixed with feedstock oil D in a mass ratio of 30:70 and used as residue hydrogenating feedstock. Reaction conditions were: a hydrogen pressure of 15.0 Mpa, a volume space velocity of 0.35 $h^{-1}$, a hydrogen-to-oil ratio is 800 $Nm^3/m^3$, a reaction temperature of 390° C. in the first 2000 hrs, and 395° C. in the last 2000 hrs. After test was carried out for 4000 hrs, the sulfur content of the hydrogenated formation oil was 0.69 wt %. Then the test was terminated, and the average carbon deposit quantity on the catalyst is analyzed to be equivalent to 12.6 wt % of the fresh hydrogenating catalyst mass.

EXAMPLE 4

The catalyst used for the hydrogenating test in present Example was the same as the hydrogenation catalyst used in Comparative Example 4. Feedstock oil B having 83 ppm of catalytic cracking catalyst particulate substance with a particle size of 14 micrometer was fine-filtered at a filtering temperature of 230° C., resulting in the content of catalytic cracking catalyst being 7 ppm with the particle size of catalytic cracking catalyst being less than 1.5 micrometer. Hydrogenating feedstock oil was a mixed oil of the feedstock oil B treated with fine filtration and feedstock oil D. Feedstock oil B from which the acidic solid impurity has been removed and feedstock oil D were mixed in a mass ratio of 30:70. The reaction was carried out under the same reaction conditions as those in Comparative Example 3: a hydrogen pressure of 15.0 Mpa, a volume space velocity of 0.35 $h^{-1}$, a hydrogen-to-oil ratio of 800 $Nm^3/m^3$, a reaction temperature of 390° C. in the first 2000 hrs, the 395° C. in the last 2000 hrs. After test was carried out for 4000 hrs, the sulfur content in the hydrogenated formation oil was 0.57 wt %. Then the test was terminated, and the average carbon deposit quantity on the catalyst was analyzed to be equivalent to 11.6 wt % of the fresh catalyst mass.

Carbon deposit on the hydrogenation catalyst of Comparative Example 4 was 1.0% higher than that on the hydrodemetallization catalyst of Example 4, showing that adding catalytic cracking catalyst fine powder will accelerate carbon deposit formation on the hydrogenation catalyst and thereby affect activity and lifetime of the hydrodemetallization. This point may be also verified from the significantly higher sulfur content of the formation oil obtained in Comparative Example 3 than that obtained in Example 3. This also shows the importance of adding fine filter for catalytic cracking heavy cycle oil. Removing off catalytic cracking catalyst powder from the catalytic cracking heavy cycle oil has significant effect to maintain the activity of residue hydrogenation catalyst and alleviate coking of residue hydrogenation catalyst.

EXAMPLE 5

The catalytic cracking heavy cycle oil contained 83 ppm of catalyst powder (acidic solid impurity) with a particle size of 14 micrometer. It was processed by rectification under a reflux ratio of 2. The yield of the distillate was 45 wt %, and the yield of the tower bottom substance was 55 wt %. The content of the acidic solid particulate substance in the distillate was measured, and the particle size was 2.5 micrometer and the concentration was decreased to 5 ppm.

EXAMPLE 6

Catalytic cracking heavy cycle oil contained 83 ppm of catalyst powder (acidic solid impurity) with a particle size of 14 micrometer. It was processed by centrifugation. The yield of the clear solution was 75% by weight, the yield of the muddy liquor containing more acidic solid particulate substance was 25% by weight. The content of acidic solid particulate substance in the clear solution was measured, and the particle size was 5 micrometer and the concentration was decreased to 15 ppm.

The invention claimed is:

1. A combined process for hydrotreating and catalytic cracking of residue, comprising:

contacting residue, catalytic cracking recycle oil and optional distillate oil with a residue hydrotreating catalyst to carry out a hydrotreating reaction under hydrotreating reaction conditions in the presence of hydrogen, and separating the reaction products obtained to obtain gas, hydrogenated naphtha, hydrogenated diesel oil and hydrogenated residue; and contacting the hydrogenated residue and optional conventional catalytic cracking feedstock oil with a catalytic cracking catalyst to carry out a cracking reaction under catalytic cracking reaction conditions, and separating the reaction products obtained to obtain dry gas, liquefied gas, catalytic cracking gasoline, catalytic cracking diesel oil and catalytic cracking recycle oil;

characterized in that the process further comprises a step for removing acidic solid impurity from the catalytic cracking recycle oil, which step makes the catalytic cracking recycle oil contain less than 30 ppm acidic solid impurity with a particle size of less than 10 μm, before the step of contacting and reacting the residue, catalytic cracking recycle oil and optional distillate oil with the residue hydrotreating catalyst.

2. The process according to claim 1, characterized in that the content of said acidic solid impurity is less than 15 ppm and the particle size of said acidic solid impurity is less than 5 μm.

3. The process according to claim 2, characterized in that the content of said acidic solid impurity is less than 5 ppm and the particle size of said acidic solid impurity is less than 2 μm.

4. The process according to claim 1, characterized in that said catalytic cracking recycle oil is one or more selected from the group consisting of heavy cycle oil, decanted oil and the catalytic cracking slurry oil remaining after separating out catalytic cracking diesel.

5. The process according to claim 1, characterized in that said step for removing acidic solid impurity from the catalytic cracking recycle oil comprises one or more methods selected from the group consisting of fine filtration, centrifugation, distillation, and flash separation.

6. The process according to claim 5, characterized in that said acidic solid impurity is removed from the catalytic cracking recycle oil using a fine filtration method.

7. The process according to claim 6, characterized in that said acidic solid impurity is removed from the catalytic cracking recycle oil using a fine filtration method at a filtration temperature of 100~350° C.

8. The process according to claim 7, characterized in that said acidic solid impurity is removed from the catalytic cracking recycle oil using a fine filtration method at a filtration temperature of 200~320° C.

9. The process according to claim 1, characterized in that the content of said catalytic cracking recycle oil in the mixed feedstock oil of the catalytic cracking recycle oil with optional residue and/or distillate oil is 3-50 wt %.

10. A combined process for hydrotreating and catalytic cracking of residue, comprising:

(1) feeding residue, catalytic cracking heavy cycle oil with acidic solid impurity being removed, optional distillate oil and optional distillate of the catalytic cracking slurry oil into a residue hydrotreating unit, carrying out a hydrotreating reaction in the presence of hydrogen gas and a hydrogenation catalyst, and separating the reaction products of the hydrotreating reaction to obtain gas, hydrogenated naphtha, hydrogenated diesel oil and hydrogenated residue;

(2) feeding the hydrogenated residue obtained from step (1) and an optional vacuum gas oil into a catalytic cracking unit, carrying out a cracking reaction in the presence of a cracking catalyst, and separating the reaction products of the cracking reaction to obtain dry gas, liquefied gas, catalytic cracking gasoline, catalytic cracking diesel oil, catalytic cracking heavy cycle oil and catalytic cracking slurry oil;

(3) processing the catalytic cracking heavy cycle oil obtained from step (2) to remove the acidic solid impurity, and the catalytic cracking heavy cycle oil after removing off the acidic solid impurity contains less than 30 ppm acidic solid impurity with a particle size of less than 10 μm; and (4) circulating the catalytic cracking heavy cycle oil obtained from step (3) after removing the acidic solid impurity to the residue hydrotreating unit.

11. The process according to claim 10, characterized in that said catalytic cracking heavy cycle oil contains less than 15 ppm of acidic solid impurity with a particle size of less than 5 μm.

12. The process according to claim 11, characterized in that said catalytic cracking heavy cycle oil contains less than 5 ppm of acidic solid impurity with a particle size of less than 2 μm.

13. The process according to claim 10, characterized in that said catalytic cracking heavy cycle oil is processed by using one or more methods selected from the group consisting of fine filtration, centrifugation, distillation, and flash separation to remove the acidic solid impurity.

14. The process according to claim 13, characterized in that said catalytic cracking heavy cycle oil is processed by using a fine filtration method to remove the acidic solid impurity.

15. The process according to claim 14, characterized in that the fine filtration method is used at a filtration temperature is 100~350° C.

16. The process according to claim 15, characterized in that the fine filtration method is used at a filtration temperature is 200~320° C.

17. The process according to claim 10, characterized in that the catalytic cracking slurry oil obtained from said step (2) is separated by distillation, and the distillate of the catalytic cracking slurry oil obtained is circulated to the residue hydrotreating unit directly or after further removing acidic solid impurity, provided that the distillate of the catalytic cracking slurry oil circulated to the residue hydrotreating unit contains less than 30 ppm of acidic solid impurity with a particle size of less than 10 μm.

18. The process according to claim 17, characterized in that the distillate of the catalytic cracking slurry oil circulated to the residue hydrotreating unit contains less than 15 ppm of acidic solid impurity with a particle size of less than 5 μm.

19. The process according to claim 18, characterized in that the distillate of the catalytic cracking slurry oil circulated to the residue hydrotreating unit contains less than 5 ppm of acidic solid impurity with a particle size of less than 2 μm.

20. The process according to claim 17, characterized in that said distillate of the catalytic cracking slurry oil has a boiling range of 400~500° C., and the distillate of the catalytic cracking slurry oil accounts for 15%~80% by weight of full fraction of the catalytic cracking slurry oil.

21. The process according to claim 10, characterized in that said residue is selected from the group consisting of vacuum residuum, atmospheric residuum, and a combination thereof.

22. The process according to claim 10, characterized in that said distillate oil is one or more selected from the group consisting of coking gas oil, deasphalted oil, vacuum gas oil, and extract oil from solvent refining.

23. The process according to claim 10, characterized in that the feedstock oil for the residue hydrotreating unit is a mixture of residue, catalytic cracking heavy cycle oil with acidic solid impurity being removed, optional distillate oil and optional distillate of catalytic cracking slurry oil, wherein the catalytic cracking heavy cycle oil from which the acidic solid impurity has been removed accounts for 3%~50% by weight of feedstock oil of the residue hydrotreating unit.

24. The process according to claim 10, characterized in that said hydrotreating reaction conditions are: a hydrogen partial pressure of 5.0~22.0 MPa, a reaction temperature of 330~450° C., a volume space velocity of 0.1~3.0 $hrs^{-1}$, and a $H_2$/Oil volume ratio of 300~2000 $Nm^3/m^3$.

25. The process according to claim 10, characterized in that said active metal component of the hydrogenation catalyst is one or more metals selected from the group consisting of VIB Group metals and VIII Group non-noble metals, and the substrate is one or more substrates selected from the group consisting of alumina, silica, and amorphous silica-alumina.

26. The process according to claim 10, characterized in that said cracking reaction conditions are: a reaction temperature of 470~650° C., a reaction time of 0.5~5 second, and a weight ratio of catalyst to feedstock oil of 3~10.

27. The process according to claim 10, characterized in that said catalytic cracking catalyst comprises 5~50 wt % of zeolite, 5~95 wt % of inorganic oxide, and 0~70 wt % of clay.

28. The process according to claim 27, characterized in that said inorganic oxide is selected from silica and alumina.

* * * * *

UNITED STATES PATENT AND TRADEMARK OFFICE

CERTIFICATE OF CORRECTION

PATENT NO. : 8,529,753 B2
APPLICATION NO. : 12/521346
DATED : September 10, 2013
INVENTOR(S) : Chuanfeng Niu et al.

It is certified that error appears in the above-identified patent and that said Letters Patent is hereby corrected as shown below:

Title page, item (57), line 4 of Abstract, "adistillate" should read --a distillate--.

Signed and Sealed this
Thirty-first Day of December, 2013

Margaret A. Focarino

Margaret A. Focarino
*Commissioner for Patents of the United States Patent and Trademark Office*